United States Patent [19]

Vogel et al.

[11] Patent Number: 5,042,735

[45] Date of Patent: Aug. 27, 1991

[54] TEXTILE MACHINE WITH BOBBIN REWIND

[75] Inventors: Walter Vogel, Niederwerrn; Hans Hermanns, Hammelberg, both of Fed. Rep. of Germany

[73] Assignee: FAG, Fed. Rep. of Germany

[21] Appl. No.: 131,417

[22] Filed: Dec. 10, 1987

[30] Foreign Application Priority Data

Dec. 20, 1986 [DE] Fed. Rep. of Germany ..... 3643772

[51] Int. Cl.[5] ..... B65H 54/02; B65H 54/22; B65H 67/06

[52] U.S. Cl. ..... 242/18 R; 242/35.5 A; 57/313

[58] Field of Search ..... 242/18 R, 35.5 R, 35.5 A, 242/47, 1

[56] References Cited

U.S. PATENT DOCUMENTS

| | | | |
|---|---|---|---|
| 2,010,465 | 8/1935 | Reiners et al. | 242/35.5 A |
| 3,257,793 | 6/1966 | Abbott | 57/313 X |
| 3,474,975 | 10/1969 | Brouwer | 242/35.5 A |
| 3,506,209 | 4/1970 | Matsui et al. | 242/35.5 A X |
| 3,774,859 | 11/1973 | Brouwer et al. | 242/35.5 A X |
| 3,966,141 | 6/1976 | Nishiyama et al. | 242/35.5 A |
| 4,164,840 | 8/1979 | Chilpan et al. | 57/313 |
| 4,544,107 | 10/1985 | Matsui et al. | 242/35.5 A |

FOREIGN PATENT DOCUMENTS

| | | |
|---|---|---|
| 3105833 | 9/1982 | Fed. Rep. of Germany . |
| 3635338 | 4/1988 | Fed. Rep. of Germany . |

*Primary Examiner*—Stanley N. Gilreath
*Attorney, Agent, or Firm*—Ostrolenk, Faber, Gerb & Soffen

[57] ABSTRACT

A textile machine has a support carrying a number of yarn dispensing spindles. The machine includes an automatic winding device movable selectively to each of the spindles for rewinding yarn on each spindle. The winding device includes a yarn supply and elements which guide the yarn to the spindle to be rewound. In one embodiment, the winding device includes an articulated arm which removes the spindle from the support, brings it to the winding device for yarn to be rewound upon the spindle and returns the spindle to the support. In a second embodiment, an empty spindle is removed from the support by one arm and a second arm delivers a full spindle to the support. In a third embodiment, the automatic winding device moves to a spindle. Then a motor associated with the respective spindle operates at a different rewind speed and yarn is supplied to the spindle spinning at rewind speed to wind the yarn upon the spindle. Upon completion of rewinding, the spindle motor operates the spindle again at the yarn dispensing speed.

7 Claims, 3 Drawing Sheets

TEXTILE MACHINE WITH BOBBIN REWIND

BACKGROUND OF THE INVENTION

The present invention relates to a textile machine on which spindles loaded with bobbins rotate. Examples of such machines include twisting, spinning, wrapping or covering machines. In each machine, the yarn is withdrawn from bobbins until the bobbins have run out.

In these machines, after the bobbins have run out, they must be removed from the spindle, transported to a winding machine which is a distance away, and be rewound there. One great disadvantage lies in having to transport the bobbins. Particularly in the case of wrapping or covering machines, a highly precise bobbin is necessary because of the high speeds of rotation (e.g. 40,000 rpm) of the spindles. That bobbin is correspondingly expensive. Constant travel of bobbins between machines is very detrimental to the bobbins leading to beat-up delivery plates, beat-up winding cores and worn seats of the bobbins. This makes the bobbins very soon unusable and leads to premature failure of the spindles.

Furthermore, frequently during transportation, freshly wound yarn becomes dirty requiring that the winding process be repeated.

Offenlegungsschrift OS 31 05 833, published Sept. 9, 1982, describes a device for removing and reinserting spindles. An entire spindle must be brought to the winding machine or, after removal of the spindle from the machine, the bobbin must be removed and brought to the winding machine for rewinding. These present not only the danger of damage to the bobbins but also of damage to the spindle.

Another disadvantage of such prior device lies in the large number of spindles required. There is a rule of thumb according to which the winding of a spindle place must be designed three to four times. This means that at least three complete spindles equipped with bobbins must be available for each spindle place. This is not feasible for economic reasons.

Offenlegungsschrift 36 35 338, published Apr. 28, 1988, describes a combination of a wrapping or covering spindle which is also used as a winding spindle on a winding machine. This also has the disadvantage that it is necessary to transport the spindles to the winding machine. During this transporting, the spindles may be damaged.

SUMMARY OF THE INVENTION

The object of the present invention is to eliminate the above described problems.

Another object is to reduce the number of spindles required in a textile machine and particularly to also reduce the number of previously wound spindles that must be available at the machine.

A further object of the invention is to eliminate the need for moving a spindle from a textile machine to a remote location for rewinding.

A further object is to permit rewinding close to the location where a spindle is used in the textile machine.

Another object is to reduce the amount of handling and traveling of a spindle, to minimize the damage the spindle may suffer over time.

In the invention, the textile machine typically includes a support for a number of spindles which deliver yarn for any one of selected purposes, the machines including twisting, spinning, wrapping or covering machines. Each spindle is supported on a support so that its position is established. An automatic winding device for the textile machine is supported for moving along the machine to selectively operate on a spindle then requiring rewinding.

The automatic winding device installed on the textile machine according to the invention replaces a complete, separate winding machine. In one embodiment, a spindle place from which the yarn has run out calls for the winding device. The winding device had already wound a new spindle. The winding device travels along with a rewound spindle to the spindle place. The device loosens the empty spindle that is fastened by a rapid fastener on the spindle bearing place. The empty spindle is automatically installed on the winding device, and a new winding process starts immediately on the empty spindle. Meanwhile, the spindle which had already been rewound is inserted by the winding device into the textile machine. Then the textile machine is restarted. The winding device is ready for the next call. In this embodiment, only one spindle more than the number required to fill the textile machine is needed.

In yet another embodiment, the winding device travels to the calling spindle place, removes the run off spindle from the machine, and installs it on the winding device. It winds the spindle and then inserts the same spindle back into the textile machine and causes it to start up again. In this case, no additional spindle is required.

In both of the above embodiments, a drive element for the spindle in the form of tangential belts, or the like is usually used.

In a further embodiment, each spindle is driven to rotate by a respective motor. Upon call, the winding device travels to the location of the run off spindle. The spindle, which had been spinning at a speed for yarn run off, is adjusted to the desired winding speed of rotation by the drive motor of the winding device. The spindle remains in its original place in the textile machine during this process. The winding device places the yarn on the spindle and winds it by means of a feeler. After winding, the spindle is again brought to its operating speed of rotation for yarn run off and is caused to start up for the corresponding operation (spinning, twisting, wrapping or covering). In this case also, no additional replacement spindle is required. The economic and functional advantages are obvious.

Other objects and features of the invention are explained with reference to the various embodiments shown in the drawings.

DESCRIPTION OF THE PREFERRED EMBODIMENTS

Figure 1:
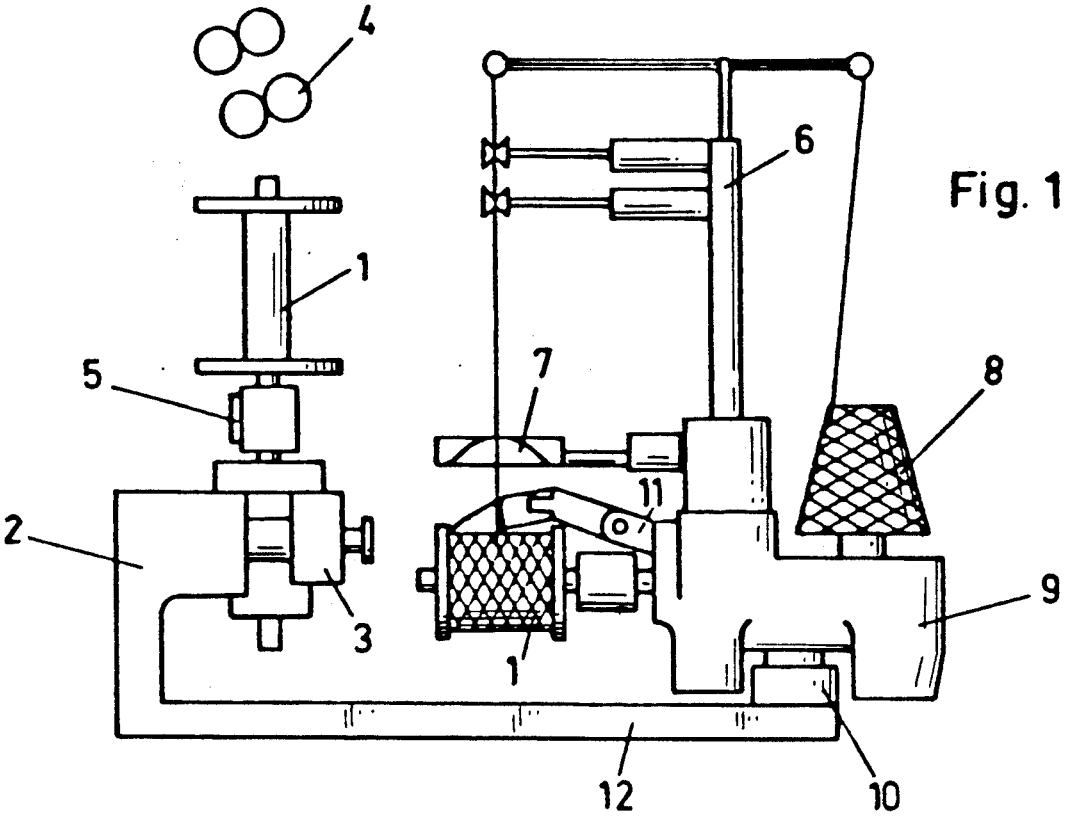
FIG. 1 shows a textile machine in the form of a covering machine, with an installed automatic winding device.
Figure 5:
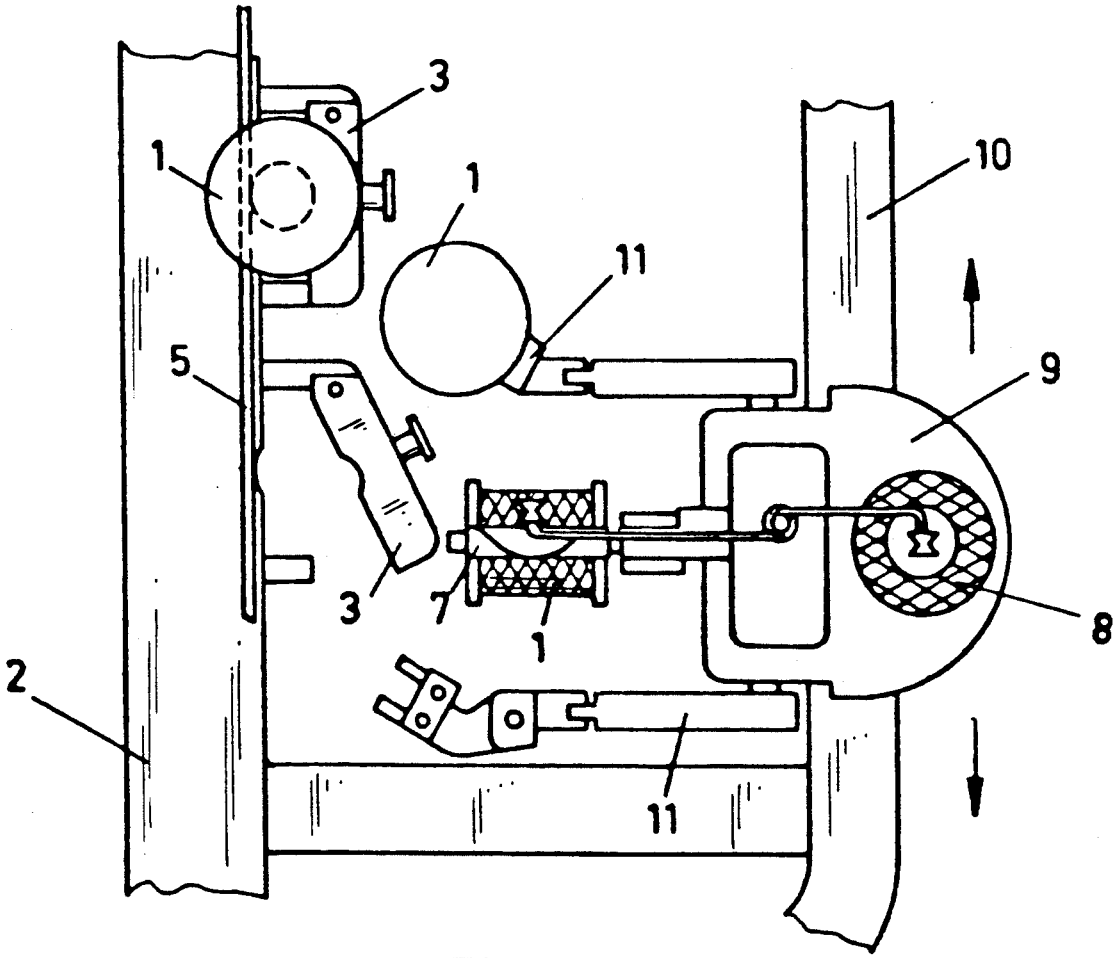
FIG. 5 shows a novel yarn twister during the replacement of the spindle.

In FIG. 1, the covering machine spindle is installed on the spindle bearing plate 2 which is on the support 12. A plurality of spindles are attached on the plate 2, each by the rapid fastener 3, which is a rapidly openable clamp, as seen in FIG. 5. The spindles are driven by the drive belt 5 in a known manner.

An automatic winding device 9 is positioned in the machine opposite the spindle 1 in their operating positions. The winding device 9 is guided on the travel rail 10 which is supported by a support 12 on the machine side. Means sense when a spindle 1 has run out and the winding device receives a call or signal that a spindle needs to be replaced. The device 9 moves along the rail to the position opposite the spindle to be replaced.

Figure 2:
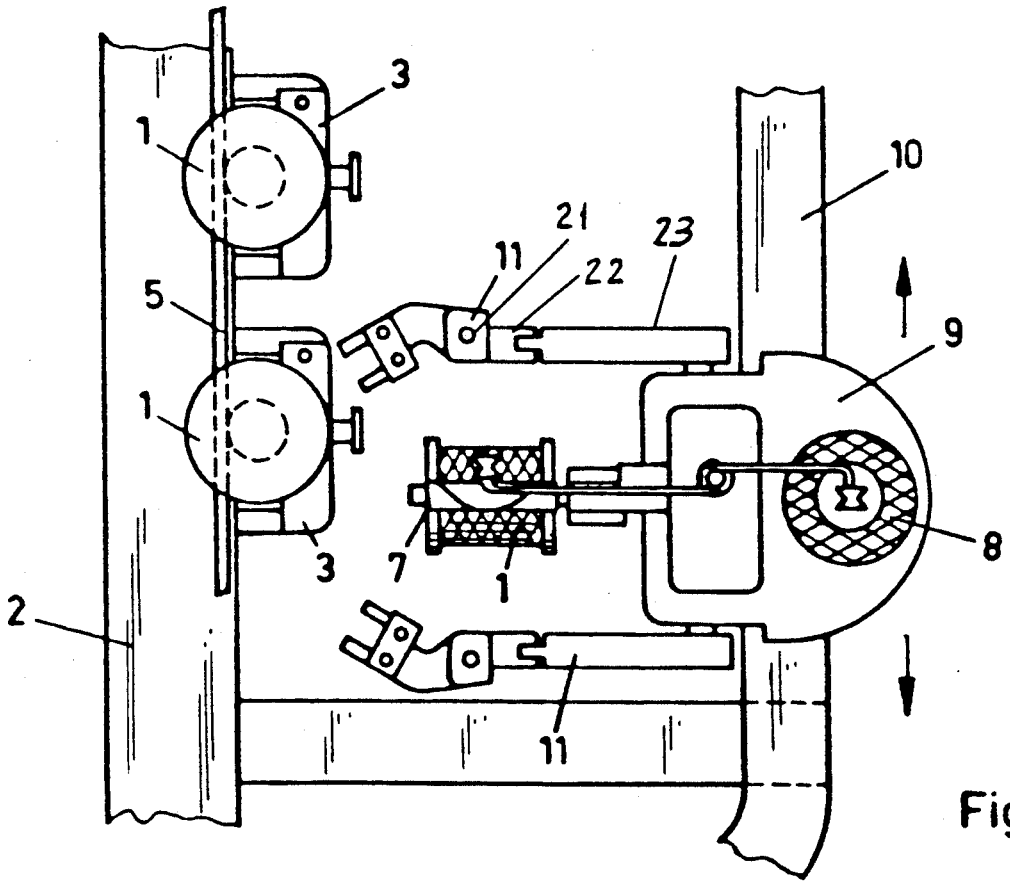
FIG. 2 is a top view of the machine of FIG. 1.

A spindle gripper 11 grips and then removes an empty spindle 1 from the spindle bearing plate 2 and installs it in the winding device 9. As can be seen in FIGS. 1 and 2, each gripper is pivot jointed around three different axes, two mutually perpendicular axes 21 and 22 near the jaw and one axis 23 at the other end of the gripper. The gripper can pick up the spindle, twist its orientation, and install the spindle at the end of the winding device, as shown.

From the delivery cop 8 yarn is conducted, via the thread guide 6, to the traversing roller 7, and from there, the thread moves to the spindle 1, where the winding process commences.

Figure 3:
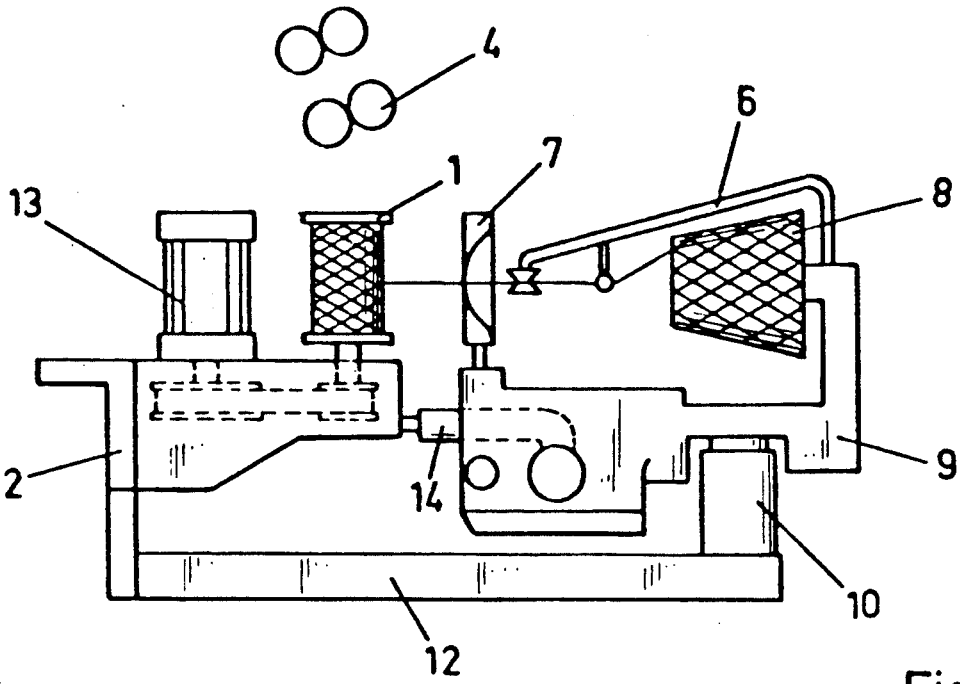
FIG. 3 shows a covering machine with motor-driven spindle during the winding process.
Figure 4:
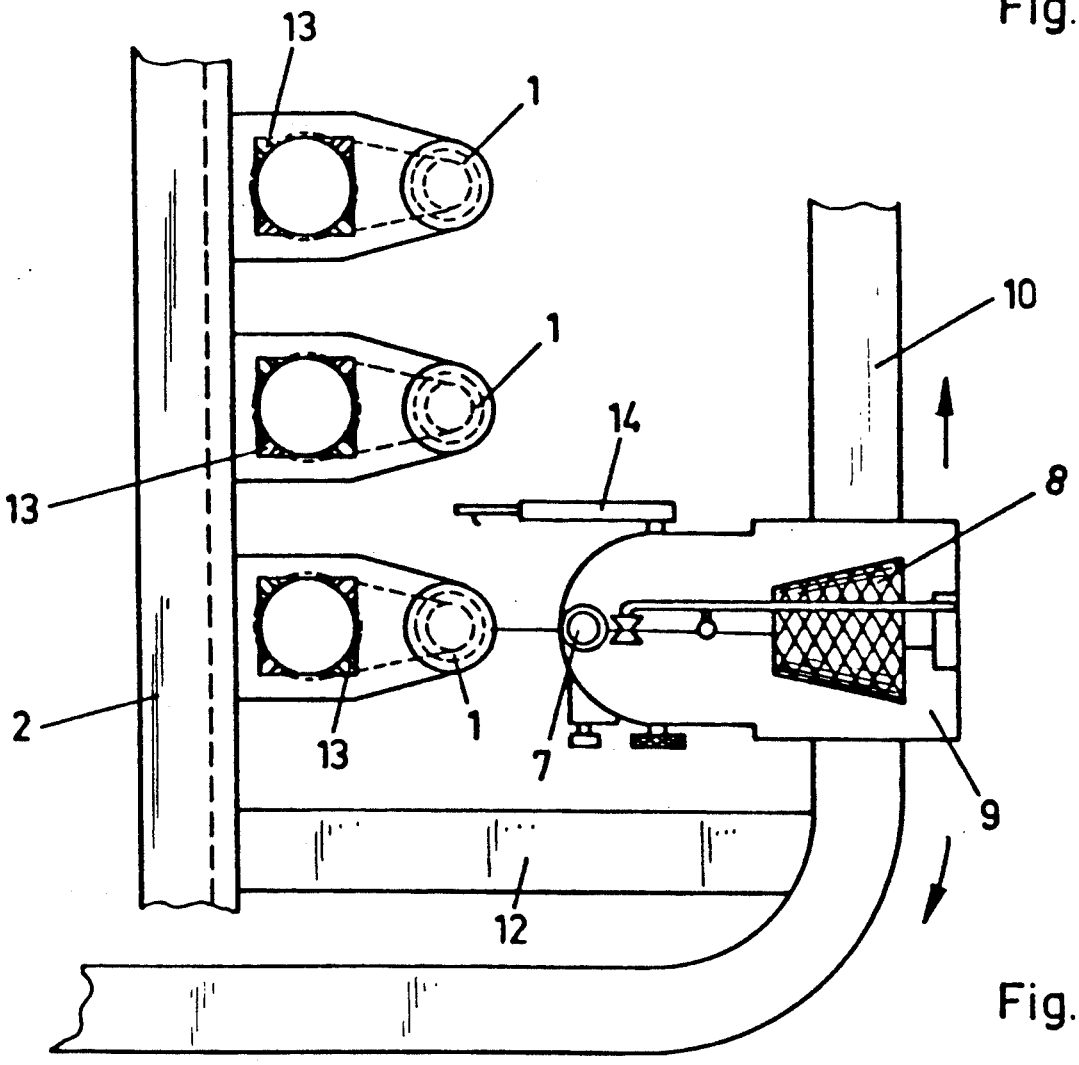
FIG. 4 is a top view of the machine of FIG. 3.

In FIG. 3, each spindle 1 is also installed on the spindle bearing plate 2 and each is driven by a respective motor 13, as shown, through a belt connection. The spindle 1 remains in its position on the plate 2, rather than being brought to a separate rewinder. Each motor normally rotates its spindle at a run off speed. A call is sent that rewinding of a spindle is needed before rewinding, the spindle requiring rewinding is brought by the motor 13 up to the winding speed. The winding of yarn takes place from the delivery cop 8 via the thread guide 6 and past the traversing roller 7. From there the thread is conducted over the thread feeler 14 and to the spindle 1. After receiving the call, the automatic winding device 9 is guided to each of the spindles requiring rewinding along the travel rail 10, which is supported on the machine side by supports 12.

FIG. 5 is a fragmentary view of a novel yarn twister in top view. After receiving a call, the device 9 moves to the area opposite the spindle requiring replacement. The spindle 1 shown has already been removed by a first gripper 11 from the spindle bearing plate 2 and has been installed in the winding device 9. The winding process takes place in the manner which was described in connection with FIG. 1. A previously wound spindle 1 is then introduced into the spindle bearing plate 2, e.g. by a second gripper 11, and is fastened there by the rapid fastener 3. The work is again taken on by the automatic gripper 11. The spindle replacement can be quite rapid since the rewound spindle can be placed on the spindle place just after the emptied spindle is removed from the spindle place and placed in the device 9. Again, the device 9 responds to a call or signal that a spindle needs to be replaced.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A textile machine comprising:

a support, a plurality of spindles supported on the support for carrying yarn and for rotation about their axes, and means for rotating the spindles around their respective axes;

an automatic winding device on the machine; means for selectively bringing any one of the spindles to the automatic winding device, and the automatic winding device including apparatus for supplying yarn to and for winding yarn on a selected one of the spindles.

2. The textile machine of claim 1, wherein the winding device includes means for removing a selected spindle from the support and means for replacing a removed spindle with another spindle.

3. The textile machine of claim 2, wherein the removed spindle has been emptied of yarn and the replaced spindle is newly wound with yarn.

4. The textile machine of claim 3, comprising a spindle rewind location on the automatic winding device, and the removal means delivers the removed spindle to the spindle rewind location at which the apparatus for winding yarn winds yarn on the removed spindle; and the spindle replacing means returns the removed spindle to its previous position on the support.

5. The textile machine of claim 4, wherein the spindle removal means comprises an arm which is articulated for bending and changing orientation so that the arm can engage the spindle to be removed at the location thereof on the support, deliver the spindle to the rewind location and move the spindle back to the previous position on the support;

first means in the automatic winding device for operating the arm to move the spindle; second means in the automatic winding device for moving the automatic winding device with respect to the support for the spindles to move the automatic winding device to each of the spindles, in turn.

6. The textile machine of claim 5, comprising two of the articulated arms, a first of the arms being the removing means for first removing a spindle to be replaced from the support, and a second of the arms being the replacing means for supporting another spindle that is to be replaced on the support and movable for moving that other spindle to its position on the support; means in the winding device for coordinating the movement of the first and second arms to first remove the spindle and to later replace the removed spindle with another spindle.

7. The textile machine of claim 1, further comprising moving means for moving the automatic winding device with respect to the support for the spindles for moving the automatic winding device to a location where it is able to operate upon a selected spindle on the support.

* * * * *